US009109470B2

(12) United States Patent
Vaughn et al.

(10) Patent No.: US 9,109,470 B2
(45) Date of Patent: Aug. 18, 2015

(54) TIMING BELT PULLEY MOUNTING AND GEOMETRY FOR USE IN INTERNAL COMBUSTION ENGINES

(71) Applicant: Honda Motor Co., Ltd., Tokyo (JP)

(72) Inventors: Christopher W. Vaughn, Mebane, NC (US); Brian C. Doklovic, Hillsborough, NC (US); Nathaniel Artemis Lenfert, Graham, NC (US)

(73) Assignee: Honda Motor Co., Ltd., Tokyo (JP)

( * ) Notice: Subject to any disclaimer, the term of this patent is extended or adjusted under 35 U.S.C. 154(b) by 156 days.

(21) Appl. No.: 13/654,811

(22) Filed: Oct. 18, 2012

(65) Prior Publication Data

US 2014/0109863 A1 Apr. 24, 2014

(51) Int. Cl.
*F02B 75/32* (2006.01)
*F01L 1/02* (2006.01)

(52) U.S. Cl.
CPC ..... *F01L 1/024* (2013.01); *Y10T 29/49231* (2015.01)

(58) Field of Classification Search
CPC ..... F02B 75/32; F02B 67/06; F01L 1/02; F01L 1/024–1/026; B21K 3/00; B21K 1/08
USPC ..... 29/888.01; 123/197.4
See application file for complete search history.

(56) References Cited

U.S. PATENT DOCUMENTS

| | | | | |
|---|---|---|---|---|
| 1,900,858 | A * | 3/1933 | Bruckner | 123/58.6 |
| 4,373,831 | A | 2/1983 | Crawford | |
| 4,603,597 | A | 8/1986 | Onorati | |
| 5,189,935 | A | 3/1993 | Rosemann | |
| 5,495,776 | A | 3/1996 | Allen | |
| 5,706,769 | A * | 1/1998 | Shimizu | 123/90.23 |
| 7,036,473 | B1 | 5/2006 | Goracy | |
| 7,334,495 | B2 | 2/2008 | Takayama | |
| 7,435,054 | B2 | 10/2008 | Hodowanec | |
| 2009/0235524 | A1 * | 9/2009 | Iwagami et al. | 29/888.01 |
| 2011/0028254 | A1 | 2/2011 | Bogner et al. | |

FOREIGN PATENT DOCUMENTS

| | | |
|---|---|---|
| JP | 10267111 | 10/1998 |

OTHER PUBLICATIONS

Stock Drive Products/Sterling Instrument, Handbook of Timing Belts and Pulleys, Aug. 8, 2002, https://web.archive.org/web/20020808103049/http://www.sdp-si.com/D265/D265cat.htm.*

* cited by examiner

*Primary Examiner* — Lindsay Low
*Assistant Examiner* — Kevin Lathers
(74) *Attorney, Agent, or Firm* — Jenkins, Wilson, Taylor & Hunt, P.A.

(57) ABSTRACT

Systems and methods for mounting a timing belt pulley to a crankshaft can include a crankshaft rotatable about a center longitudinal axis, the crankshaft including a pin assembly configured for connection to a reciprocating piston. A timing belt pulley can be positioned against the pin assembly and configured for engaging the pin assembly such that the timing belt pulley is coupled to the crankshaft for rotation about the center longitudinal axis. For example, the pin assembly can include a slot formed on an exterior surface thereof, and the timing belt pulley can include a key extending towards the pin assembly and configured for engaging the slot.

20 Claims, 4 Drawing Sheets

TIMING BELT PULLEY MOUNTING AND GEOMETRY FOR USE IN INTERNAL COMBUSTION ENGINES

BACKGROUND

In small internal combustion engines, such as those used to provide the driving force for powered equipment (e.g., lawnmowers, snow blowers), a timing belt is commonly used to connect the crankshaft to the camshaft(s), which in turn controls the opening and closing of the engine's valves. In one particular configuration, a powder metal (PM) timing gear can be pressed onto the crankshaft to drive timing belt to thereby control the overhead cam system. In such a configuration, friction is the only resistance that prevents motion relative to the crankshaft, but where the PM gear is well-made and properly sized, this arrangement can provide good, reliable performance. Ensuring proper sizing can have the tendency to increase manufacturing time on the crankshaft production line, however, and such a configuration can be relatively expensive to produce. In addition, the cost of the PM gear can be relatively high, and manufacturing efficiency is not a good as it could be.

In another common configuration, a timing gear can be slip-fit onto a shaft portion of the crankshaft and held in position by engaging a machined slot formed in the shaft portion. In particular, a protrusion on the timing gear can be engaged with a keyway on the shaft portion of the crankshaft such that the timing gear is mounted at a predetermined angular relationship with respect to the crankshaft. In such a structure, however, a torsional stress due to a driving torque can tend to occur on the keyway of the crankshaft, which can thereby create a tendency of breakdown of the crankshaft along the keyway.

As a result, it would be desirable for an alternative configuration for coupling a timing gear to a crankshaft that is easier to assemble and more cost-effective than a press-fit PM gear but more reliable than simple slot-and-key connections.

SUMMARY

In accordance with this disclosure, systems and methods for mounting a timing belt pulley to a crankshaft are provided. In one aspect, a drive system for an internal combustion engine is provided. The drive system can comprise a crankshaft rotatable about a center longitudinal axis, the crankshaft comprising a pin assembly configured for connection to a reciprocating piston. A timing belt pulley can be positioned against the pin assembly and configured for engaging the pin assembly such that the timing belt pulley is coupled to the crankshaft for rotation about the center longitudinal axis.

In another aspect, a drive system for an internal combustion engine can comprise a crankshaft rotatable about a center longitudinal axis, the crankshaft comprising a crank pin connected to the crankshaft and spaced radially from the center longitudinal axis and configured for connection to a reciprocating piston, and a counterweight connected to the crankshaft substantially opposing the crank pin, the counterweight comprising a slot formed on an exterior surface thereof. A timing belt pulley can be mounted to the crankshaft for rotation about the center longitudinal axis, the timing belt pulley comprising a key extending towards the counterweight and configured for engaging the slot.

In another aspect, a method for mounting a timing belt pulley on a crankshaft comprising a pin assembly configured for connection to a reciprocating piston is provided. The method can comprise positioning a timing belt pulley against the pin assembly and engaging the timing belt pulley with the pin assembly such that the timing belt pulley is coupled to the crankshaft for rotation about the center longitudinal axis.

Although some of the aspects of the subject matter disclosed herein have been stated hereinabove, and which are achieved in whole or in part by the presently disclosed subject matter, other aspects will become evident as the description proceeds when taken in connection with the accompanying drawings as best described hereinbelow.

BRIEF DESCRIPTION OF THE DRAWINGS

The features and advantages of the present subject matter will be more readily understood from the following detailed description which should be read in conjunction with the accompanying drawings that are given merely by way of explanatory and non-limiting example, and in which.

DETAILED DESCRIPTION

Figure 1A:
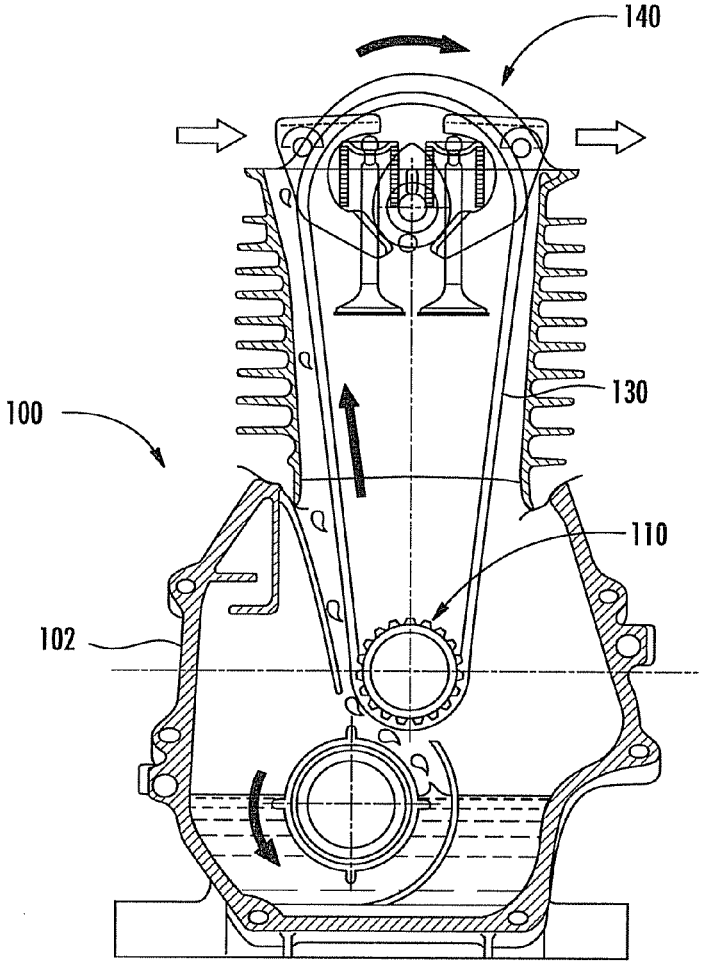
FIGS. 1*a* and 1*b* are side cutaway views of an internal combustion engine according to an embodiment of the presently disclosed subject matter.
Figure 1B:
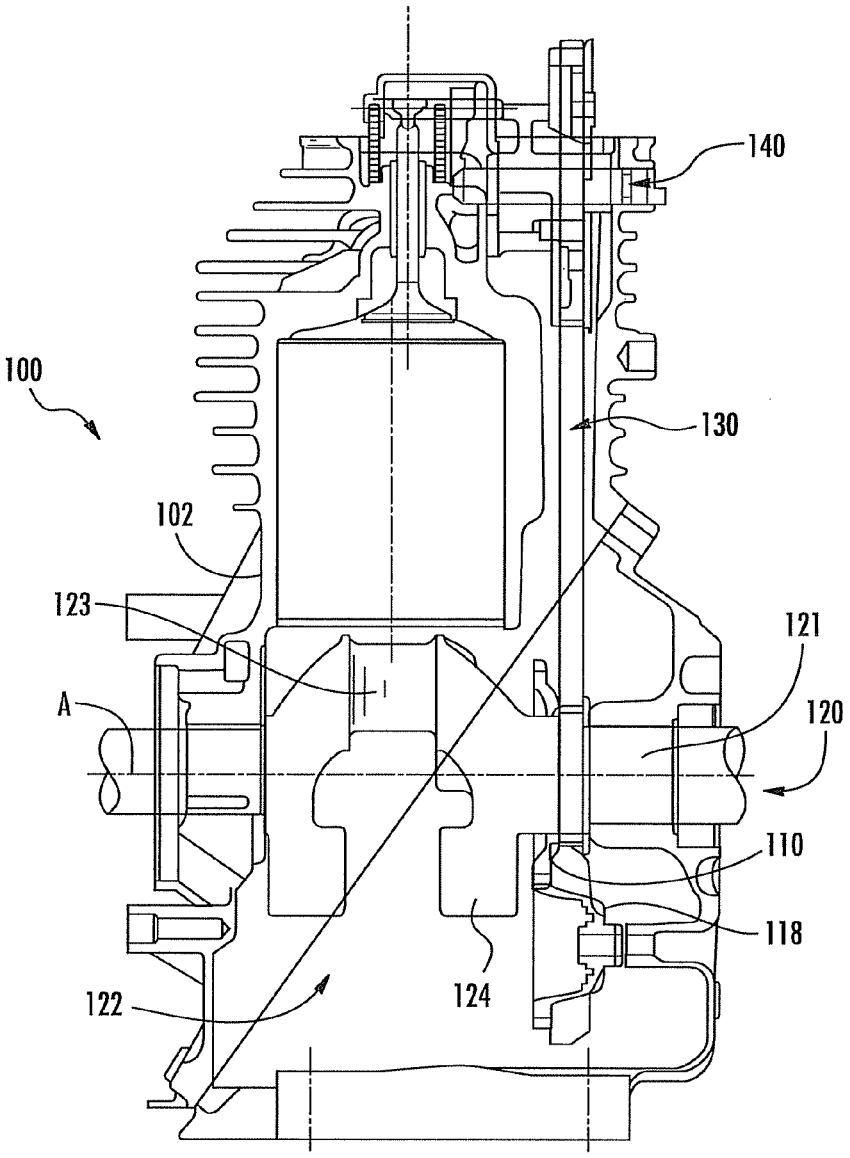

The present subject matter provides systems and methods for mounting a timing belt pulley to a crankshaft. In one aspect, the present subject matter provides a drive system for an internal combustion engine. Referring to FIGS. 1A and 1B, an internal combustion engine, generally designated 100, can comprise a crankcase 102 in which the drive system can be housed. A crankshaft, generally designated 120, can be positioned for rotation within crankcase 102 about a center longitudinal axis A. Crankshaft 120 can comprise a shaft portion 121 and a pin assembly 122 configured for connection to a reciprocating piston. Specifically, for example, pin assembly 122 can comprise a crank pin 123 connected to shaft portion 121 of crankshaft 120 and spaced radially from center longitudinal axis A. Crank pin 123 can be connected to a connecting rod of the reciprocating piston such that the linear motion of the reciprocating piston can be translated into rotation of shaft portion 121 of crankshaft 120. Pin assembly 122 can further comprise a counterweight 124 connected to shaft portion 121 of crankshaft 120 substantially opposing crank pin 123. As understood by those having skill in the art, counterweight 124 can provide balance to compensate for the eccentric rotation of crank pin 123 about center longitudinal axis A.

As discussed above, a camshaft 140 (e.g., an overhead camshaft and associated valve assemblies) can be connected to crankshaft 120 by way of a timing belt 130. This connection can be achieved by coupling a timing belt pulley, generally designated 110, to crankshaft 120 for rotation together about center longitudinal axis A. In particular, timing belt pulley 110 can comprise a central bore that is sized to be slip fit or otherwise mounted about shaft portion 121 of crankshaft 120 so as to be substantially coaxial with shaft portion 121. As shown in FIGS. 1A and 1B, timing belt pulley 110 can comprise a first gear 114 configured for operably engaging timing belt 130 to thereby drive the rotation of camshaft 140.

In addition, timing belt pulley 110 can further comprise a second gear 116 configured for coupling with a governor system 118. To prevent interference between the connections of first gear 114 and those of second gear 116, first and second gears 114 and 116 can be configured to have different diameters. For example, first gear 114 can have a first diameter and second gear 116 can have a second diameter that is greater than the first diameter. In the particular configuration shown in FIG. 1B, for example, second gear 116 can be sized and positioned such that it can directly engage (i.e., mesh) with a gear associated with governor system 118 without impacting the coupling of first gear 114 with timing belt 130. Alternatively, governor system 118 can be driven by a separate element from timing belt pulley 110 (e.g., a separate gear mounted on crankshaft 120 using conventional connection mechanisms).

Figure 2:
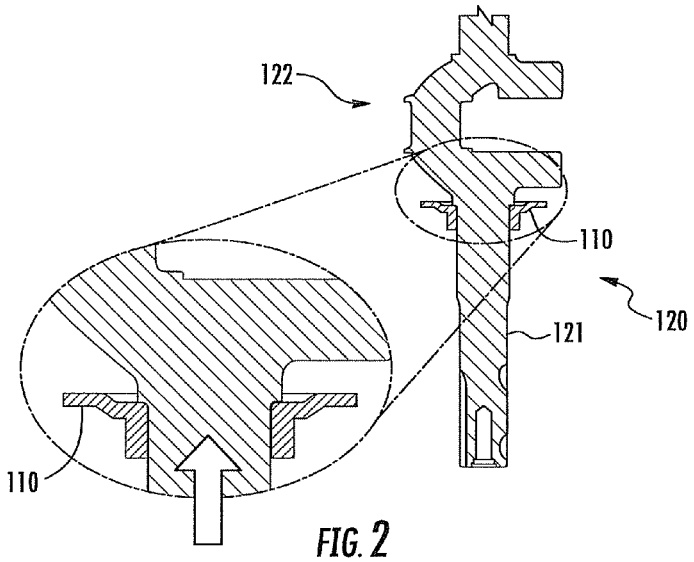
FIG. 2 PRIOR ART
FIG. 2 is a side cutaway view of a timing gear coupled to a crankshaft using methods known in the art.

Regarding the coupling of timing belt pulley 110 to crankshaft 120, rather than being press-fit or otherwise directly coupled to shaft portion 121 of crankshaft 120 (See, e.g., FIG. 2), timing belt pulley 110 can be configured to connect with pin assembly 122 of crankshaft 120. Specifically, timing belt pulley 110 can be configured for positioning against pin assembly 122 and engaging at least a portion of pin assembly 122 so as to become rotationally coupled with pin assembly 122. In one particular configuration shown in FIGS. 3, 4A, and 4B, for example, timing belt pulley 110 can be configured for abutting counterweight 124 and engaging a portion of counterweight 124. By coupling timing belt pulley 110 to counterweight 124, the rotation of timing belt pulley 110 can be driven by a comparatively low-stress side of crankshaft 120. In this way, timing belt pulley 110 can be driven without imposing additional stress risers on either of pin assembly 122 or shaft portion 121.

Figure 3:
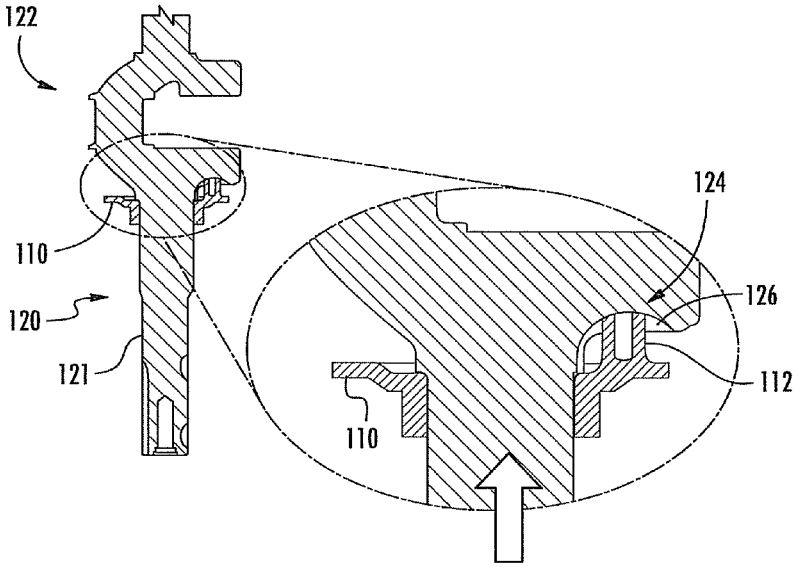
FIG. 3 is a side cutaway view of a timing gear coupled to a crankshaft according to an embodiment of the presently disclosed subject matter.
Figure 4A:
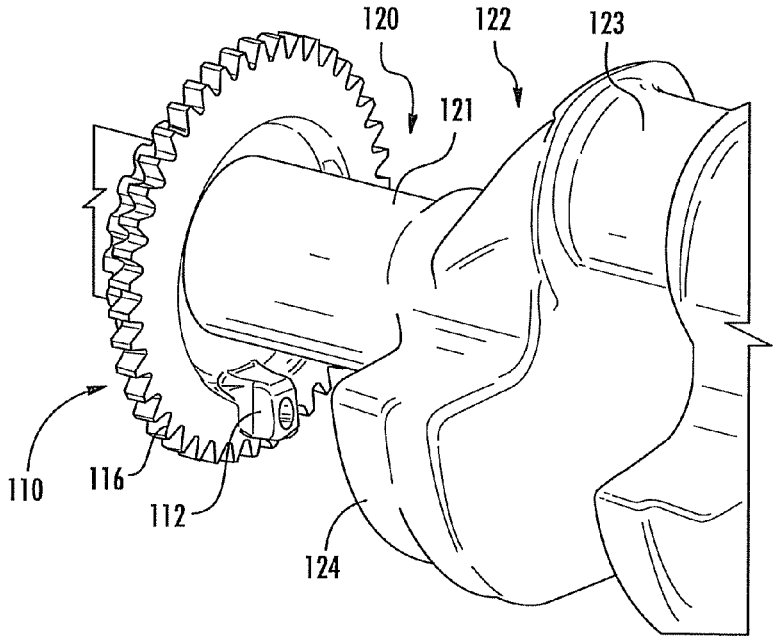
FIGS. 4*a* and 4*b* are perspective views of an interface between a timing gear and a crank pin assembly of a crankshaft according to an embodiment of the presently disclosed subject matter.
Figure 4B:
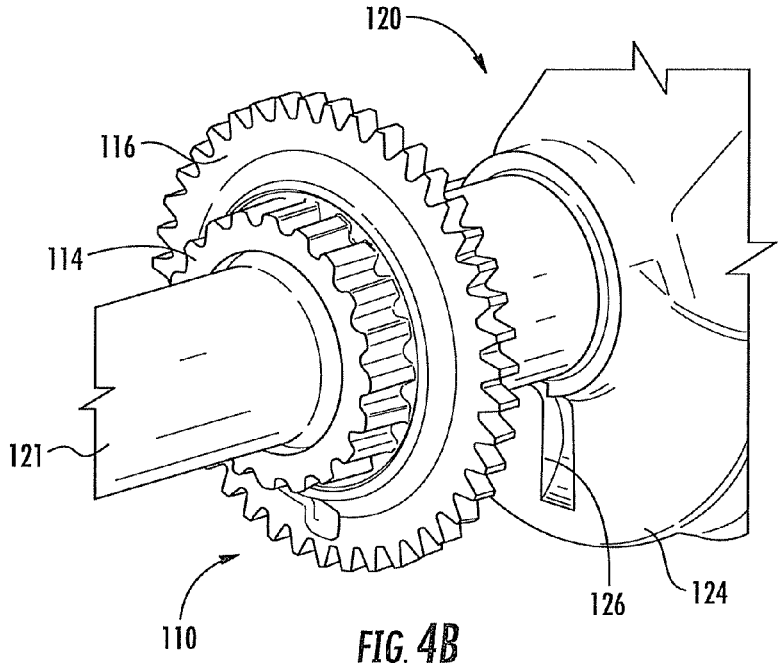

Regardless of the specific point or points of contact, this connection can be achieved by providing at least one key 112 extending axially from a face of timing belt pulley 110 towards pin assembly 122 as shown in FIGS. 3 and 4A. Referring to FIG. 3, pin assembly 122 can comprise at least one complementary slot 126 formed therein that can be configured for receiving key 112. For example, as shown in FIGS. 3 and 4B, slot 126 can have an elongate shape that can be longer than the dimension of key 112. In addition, slot 126 can have a substantially arcuate profile wherein the depth of slot 126 gradually increases to a maximum depth at or about a radial position that is substantially aligned with the radial position of key 112. With this configuration, key 112 can be substantially angularly constrained for efficiently transmitting rotation of crankshaft 120 into rotation of timing belt pulley 110, but key 112 can be free to slide to a small degree in a radial direction to account for differential thermal expansion, localized deformation of timing belt pulley 110 or any other deformation of timing belt pulley 110.

Regarding the particular positioning of slot 126, FIGS. 3 through 4B illustrate that slot 126 can be provided in an exterior surface of counterweight 124. In this configuration, by moving the connection of timing belt pulley 110 off of shaft portion 121 of crankshaft 120 an onto pin assembly 122, the stress concentrator created by conventional slot-and-key connections is eliminated, thereby improving the service life of crankshaft 120. Instead, slot 126 is formed in a component of the system (e.g., counterweight 124) that is not exposed to the same operating stresses experienced at crankshaft 120. In addition, by coupling timing belt pulley 110 to crankshaft 120 at a position that is very close to pin assembly 122 (e.g., at or near counterweight 124), the combined assembly of rotating bodies can span a smaller space within crank case 102.

Furthermore, because timing belt pulley 110 can be coupled to crankshaft 120 at a location where the stresses are low, the impact of a stress concentration at these areas can minimize stress that timing belt pulley 110 is subjected to during its operation. As a result, it will be appreciated that this system and method allows for more efficient use of materials used to fabricate and machine timing belt pulley 110. In addition, machining the mechanical mount of timing belt pulley 110 to pin assembly 122 can be accomplished with looser tolerances and use of less costly material. For instance, timing belt pulley 110 can comprise a resin-based material. In particular, for example, timing belt pulley 110 can comprise a nylon-resin material. In addition, the nylon material can be reinforced with minerals or glass fibers to improve strength and resist warping from extreme temperatures.

In this way, one of ordinary skill in the art will recognize that the present systems and methods can lower stresses on both timing belt pulley 110 and crankshaft 120 (e.g., by putting the driving feature of the system on a "low-stress" side of crankshaft 120), reduce fabrication costs of timing belt pulley 110 with the use of less costly material, and improve manufacturing efficiency through reduced downtime.

This written description uses examples to disclose the subject matter, including the best mode, and also to enable any person skilled in the art to make and use the subject matter herein. The patentable scope of the subject matter is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal languages of the claims.

What is claimed is:

1. A drive system for an internal combustion engine comprising:

a crankshaft rotatable about a center longitudinal axis, the crankshaft comprising a shaft portion and a pin assembly configured for connection to a reciprocating piston, the pin assembly comprising a slot formed on an exterior surface thereof;

a timing belt pulley positioned about the shaft portion against the pin assembly and comprising a key extending towards the pin assembly and configured for engaging the slot such that the timing belt pulley is coupled to the crankshaft for rotation about the center longitudinal axis; and a counterweight connected to the shaft portion;

wherein the slot is formed on an exterior surface of the counterweight that faces the timing belt pulley.

2. The drive system of claim 1, wherein the pin assembly comprises:

a crank pin connected to the shaft portion substantially opposing the counterweight and spaced radially from the center longitudinal axis.

3. The drive system of claim 1, wherein the timing belt pulley comprises a nylon resin material.

4. The drive system of claim 1, wherein the timing belt pulley is coupled to a camshaft assembly associated with the reciprocating piston.

5. The drive system of claim 4, comprising a timing belt coupling the timing belt pulley to the camshaft assembly.

6. The drive system of claim 1, wherein the timing belt pulley comprises:

a first gear configured for driving a timing belt connected to an overhead camshaft assembly; and a second gear configured for coupling with a governor system.

7. The drive system of claim 6, wherein the first gear has a first diameter and the second gear has a second diameter that is different than the first diameter.

8. The drive system of claim 7, wherein the first diameter is smaller than the second diameter.

9. The drive system of claim 1, wherein the slot formed on the exterior surface of the pin assembly has an elongate shape that extends a radial distance with respect to the center longitudinal axis that is longer than a length of the key; and wherein the key is substantially angularly constrained but is moveable in a radial direction with respect to the center longitudinal axis within the slot.

10. A drive system for an internal combustion engine comprising:

a crankshaft rotatable about a center longitudinal axis, the crankshaft comprising:

a shaft portion;

a crank pin connected to the shaft portion and spaced radially from the center longitudinal axis and configured for connection to a reciprocating piston; and a counterweight connected to the shaft portion substantially opposing the crank pin, the counterweight comprising a slot formed on an exterior surface thereof; and a timing belt pulley mounted about the shaft portion for rotation about the center longitudinal axis, the timing belt pulley comprising a key extending towards the counterweight and configured for engaging the slot.

11. The drive system of claim 10, wherein the timing belt pulley comprises a nylon resin material.

12. The drive system of claim 10, wherein the timing belt pulley is coupled to a camshaft assembly associated with the reciprocating piston.

13. The drive system of claim 12, comprising a timing belt coupling the timing belt pulley to the camshaft assembly.

14. The drive system of claim 10, wherein the timing belt pulley comprises:

a first gear configured for driving a timing belt connected to an overhead camshaft assembly; and a second gear configured for coupling with a governor system.

15. The drive system of claim 10, wherein the slot formed on the exterior surface of the counterweight has an elongate shape that extends a radial distance with respect to the center longitudinal axis that is longer than a length of the key; and wherein the key is substantially angularly constrained but is moveable in a radial direction with respect to the center longitudinal axis within the slot.

16. A method for mounting a timing belt pulley on a crankshaft of an internal combustion engine, the crankshaft comprising a shaft portion, a counterweight connected to the shaft portion, and a pin assembly configured for connection to a reciprocating piston, the method comprising:

positioning a timing belt pulley about the shaft portion against the pin assembly;

aligning a slot formed on an exterior surface of the pin assembly with a key extending from the timing belt pulley towards the pin assembly; and engaging the key on the timing belt pulley with the slot in the pin assembly such that the timing belt pulley is coupled to the crankshaft for rotation about the center longitudinal axis;

wherein the slot is formed on an exterior surface of the counterweight that faces the timing belt pulley.

17. The method of claim 16, wherein the pin assembly comprises a crank pin connected to the shaft portion substantially opposing the counterweight and spaced radially from the center longitudinal axis.

18. The method of claim 16, comprising coupling the timing belt pulley to a camshaft assembly associated with the reciprocating piston.

19. The method of claim 18, wherein coupling the timing belt pulley to a camshaft assembly associated with the reciprocating piston comprises coupling a timing belt between the timing belt pulley to the camshaft assembly.

20. The method of claim 16, comprising:

coupling a first gear on the timing belt pulley to an overhead camshaft assembly associated with the reciprocating piston; and coupling a second gear on the timing belt pulley to a governor system.

* * * * *